US005104109A

United States Patent [19]

Kubo

[11] Patent Number: 5,104,109

[45] Date of Patent: Apr. 14, 1992

[54] PAPER SHEET DELIVERY/STACKING CONTROL SYSTEM USING FUZZY INFERENCE

[75] Inventor: Ichiro Kubo, Takatsuki, Japan

[73] Assignee: Omron Tateisi Electronics Co., Kyoto, Japan

[21] Appl. No.: 412,222

[22] Filed: Sep. 25, 1989

[30] Foreign Application Priority Data

Sep. 30, 1988 [JP] Japan ..... 63-247923

[51] Int. Cl.[5] ..... B65H 5/22

[52] U.S. Cl. ..... 271/3.1; 271/110; 271/126; 271/152; 271/154; 271/215; 395/3

[58] Field of Search ..... 271/3, 3.1, 4, 110, 271/117, 126, 147, 149, 152, 153, 154, 155, 213, 214, 215, 217; 364/513

[56] References Cited

U.S. PATENT DOCUMENTS

| | | | |
|---|---|---|---|
| 4,566,685 | 1/1986 | Irvine et al. | 271/152 X |
| 4,872,763 | 10/1989 | Higuchi et al. | 222/56 X |
| 4,919,412 | 4/1990 | Weigel et al. | 271/152 X |
| 4,976,377 | 12/1990 | Higuchi et al. | 222/63 X |

FOREIGN PATENT DOCUMENTS

| | | | |
|---|---|---|---|
| 148310 | 5/1985 | European Pat. Off. . | |
| 221500 | 5/1987 | European Pat. Off. . | |
| 3706810 | 3/1988 | Fed. Rep. of Germany . | |
| 10028 | 1/1977 | Japan | 271/153 |
| 92838 | 5/1984 | Japan | 271/155 |
| 61-012535 | 1/1986 | Japan . | |
| 88730 | 4/1987 | Japan | 271/217 |
| 111835 | 4/1987 | Japan | 271/126 |
| 62-121172 | 6/1987 | Japan . | |
| 201736 | 9/1987 | Japan | 271/110 |
| 171719 | 7/1988 | Japan | 271/155 |
| 212623 | 9/1988 | Japan | 271/155 |
| 317923 | 12/1989 | Japan | 271/126 |
| 127327 | 5/1990 | Japan | 271/152 |
| 651187 | 11/1964 | Netherlands . | |

*Primary Examiner*—Joseph E. Valenza
*Assistant Examiner*—Boris Milef
*Attorney, Agent, or Firm*—Dickstein, Shapiro & Morin

[57] ABSTRACT

Paper sheets, which are typified by bank notes, are maintained substantially upright between a freely movable pressure plate and a rotatively driven delivery/-stacking roller opposing the pressure plate. Contact pressure which the delivery/stacking roller applies to the paper sheets is sensed by a pressure sensor. With the sensed contact pressure serving as an input, fuzzy inference is performed in accordance with predetermined rules, thereby to control the movement of the pressure plate in such a manner that the contact pressure will attain a proper value at all times.

5 Claims, 6 Drawing Sheets

Fig.3

| PRESSURE ERROR e \ DIFFERENTIATED VALUE e' | NL | NM | NS | ZR | PS | PM | PL |
|---|---|---|---|---|---|---|---|
| PL | ZR | NS | NM | NL | NL | NL | NL |
| PM | PS | ZR | NS | NM | NL(4) | NL | NL |
| PS | PM | PS | ZR(3) | NS | NM(2) | NL | NL |
| ZR | PL | PM | PS(1) | ZR | NS | NM | NL |
| NS | PL | PL | PM | PS | ZR | NS | NM |
| NM | PL | PL | PL | PM | PS | ZR | NS |
| NL | PL | PL | PL | PL | PM | PS | ZR |

PAPER SHEET DELIVERY/STACKING CONTROL SYSTEM USING FUZZY INFERENCE

BACKGROUND OF THE INVENTION

1. Field of the Invention

This invention relates to a paper sheet delivery/stacking apparatus used in a system for processing paper sheets such as bank notes and having means for controlling movement of a pressure plate which presses the paper sheets against a delivery/stacking portion.

A paper sheet delivery/stacking apparatus covers the concept of a paper sheet delivery apparatus, a paper sheet stacking apparatus and an apparatus which performs the functions of both delivering and stacking paper sheets.

A paper sheet delivery/stacking apparatus is incorporated in a paper sheet processing system such as a bank transaction processing system which automatically performs transactions for deposits and withdrawals, an automated teller's machine which handles bank notes or the like.

2. Description of the Prior Art

FIG. 5 illustrates the structure of a paper sheet delivery/stacking apparatus according to the prior art. Paper sheets 11, which are bank notes, by way of example, are placed on a base plate 12 of an accommodating portion longitudinally thereof and are stacked on their long or short sides, with their upper portions tilted slightly to the rear. The paper sheets 11 are sandwiched between a pressure plate 13 and a delivery/stacking portion.

The delivery/stacking portion includes a delivery/stacking roller 16 in contact with the foremost paper sheet 11, a roller 14 which stacks one paper sheet 11, and a roller 15 which delivers one paper sheet 11. The stacking roller 14 is supported on a shaft 18 and is rotatively driven by a motor, not shown, when a paper sheet is stacked. A lever 17 is rockably supported at one end on the shaft 18, and the other end of the lever 17 is rockably connected to one end of another lever 19 by a shaft 20. The delivery/stacking roller 16 is supported on the shaft 20 and is rotatively driven by a motor, not shown. Formed in the other end portion of the lever 19 is an oblong hole 19*a* extending longitudinally of the lever 19. A pin 21 secured to a frame (not shown) is fitted into the oblong hole 19*a* and is free to slide therealong. A pressuring spring 24 is stretched between the levers 17 and 19 and urges the delivery/stacking roller 16 in the direction of the paper sheets 11. The delivery roller 15 is rotatively driven by a motor, not shown, when a paper sheet is delivered. An auxiliary roller 22 is in contact with the delivery roller 15.

The pressure plate 13 is supported on a support member 23 and is movable to the left and right along with the support member 23 by a motor, not shown. The contact pressure which the delivery/stacking roller 16 applies to the paper sheets 11 is raised by moving the pressure plate 13 to the left in FIG. 5. Conversely, when the pressure plate 13 is moved to the right, the contact pressure diminishes.

In the delivery/stacking apparatus constructed as set forth above, it is necessary to change the contact pressure of the roller 16 on the paper sheets when the paper sheets are delivered or stacked. When paper sheets are stacked, the pressure plate 13 is moved relatively to the right so that the roller 16 is shifted, by the action of the pressuring spring 24, to the position indicated by the solid line in FIG. 5, whereby the contact pressure of the roller 16 on the paper sheets is weakened. When paper sheets are delivered, the pressure plate 13 is moved relatively to the left so that the roller 16 is shifted to the position indicated by the phantom line in FIG. 5, thereby increasing the contact pressure.

However, with the foregoing arrangement and control of contact pressure, it is not possible to follow up a dynamic pressure change which differs depending upon the number of paper sheets stacked, the quality of the paper sheets or the stacked state of the paper sheets. As a result, jamming of the paper sheets can occur during stacking and the paper sheets may not be delivered correctly. For example, when a paper sheet 11A to be stacked arrives at the roller 16 during the stacking of paper sheets, the roller 16 momentarily moves away from the accommodated paper sheets, as shown by the phantom line in FIG. 6*a*. However, the roller 16 soon returns in the direction approaching the accommodated paper sheets 11, as indicated by the phantom lines in FIG. 6*b*, at which time the contact pressure of the roller 16 on the paper sheets momentarily rises. Moreover, the roller 16 is being rotatively driven at this time. As a consequence, the paper sheet 11A is fed in downwardly by an excessive amount and is forced downwardly againt the base plate 12. The end result is an abnormal stacking state.

SUMMARY OF THE INVENTION

An object of the present invention is to control movement of the aforementioned pressure plate based on fuzzy inference, whereby the contact pressure of the aforementioned delivery/stacking roller on the paper sheets can be maintained at the proper value at all times to preclude the occurrence of abnormal stacking and abnormal delivery.

According to the present invention, the foregoing object is attained by providing a paper sheet delivery/stacking apparatus comprising a freely movable pressure plate and a delivery/stacking roller for holding a plurality of paper sheets in a substantially upright attitude, the delivery/stacking roller being rotatively driven and disposed opposite the pressure plate with the paper sheets embraced therebetween; pressure sensing means for sensing pressure which acts between the delivery/stacking roller and the paper sheets; movement drive means for moving the pressure plate in a direction in which the paper sheets are arrayed; and fuzzy inference means receiving an output detection signal from the pressure sensor means as an input for performing fuzzy inference in accordance with predetermined control rules set so as to maintain the pressure at a proper magnitude at all times, and for outputting a signal which controls the movement drive means based on results of the fuzzy inference.

The delivery/stacking apparatus of the invention has a delivery/stacking section provided with a pressure sensor which constantly senses the contact pressure of the delivery/stacking roller on the paper sheets. The output signal of the pressure sensor is fed into a fuzzy control section, where control for moving the pressure plate is performed in such a manner that the pressure will attain a proper value.

In accordance with the invention as set forth above, the pressure between the delivery/stacking roller and the paper sheets is controlled to assume a proper value at all times by means of fuzzy control. This makes it possible to realize stabilized delivery and stacking so that almost no stack jamming occurs.

Other features and advantages of the present invention will be apparent from the following description taken in conjunction with the accompanying drawings.

BRIEF DESCRIPTION OF THE DRAWINGS

FIG. 3 is a diagram showing, in the form of a table, fuzzy rules provided in the fuzzy control section;

DESCRIPTION OF THE PREFERRED EMBODIMENT

Figure 1:
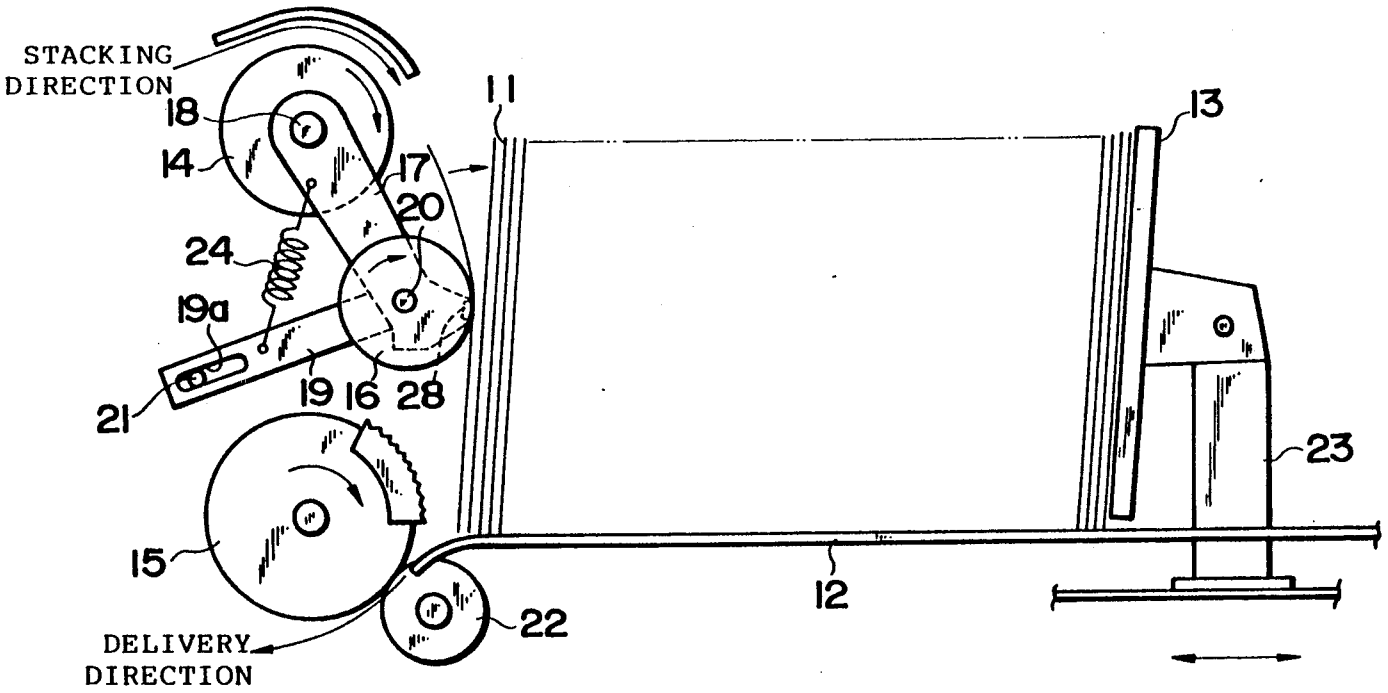
FIG. 1 is a view showing the structure of a paper sheet delivery/stacking apparatus embodying the present invention.

FIG. 1 is a view showing the structure of a paper sheet (bank note) delivery/stacking apparatus embodying the present invention.

Figure 5:
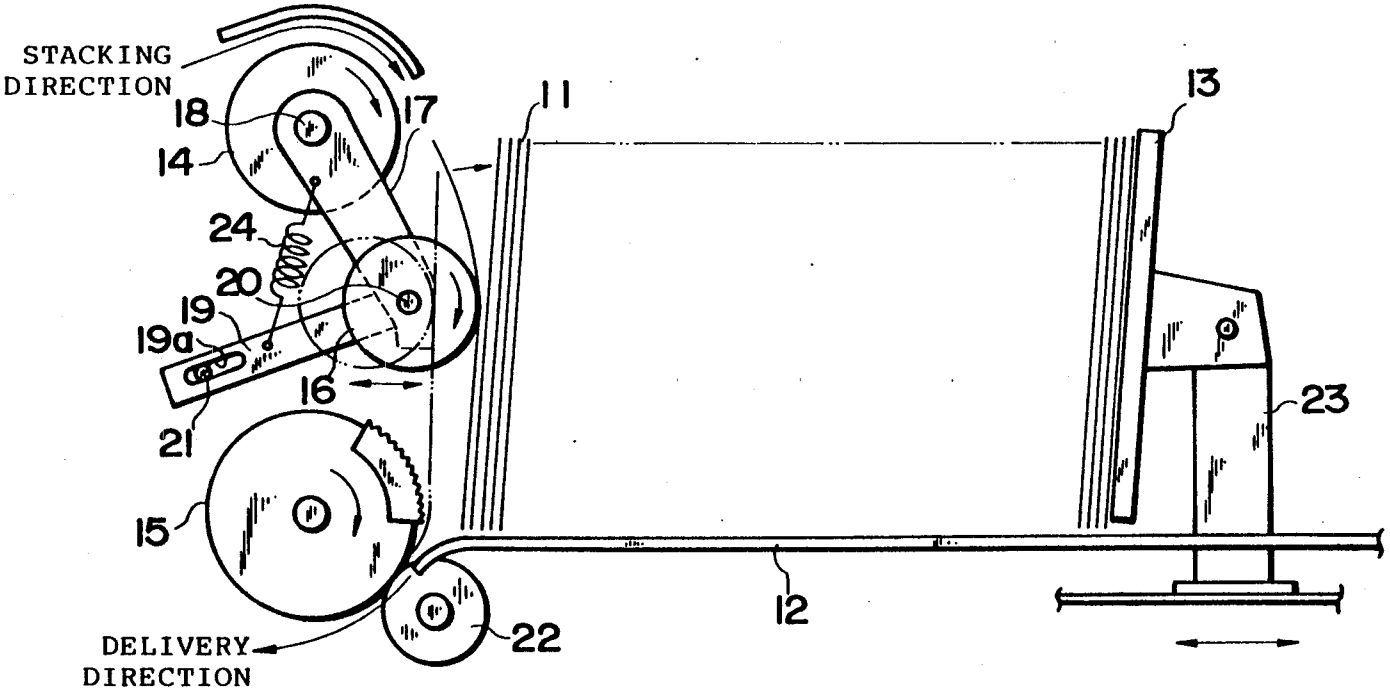
Fig. 5 PRIOR ART
FIG. 5 is a view showing the structure of a conventional delivery/stacking apparatus.
Figure 6A:
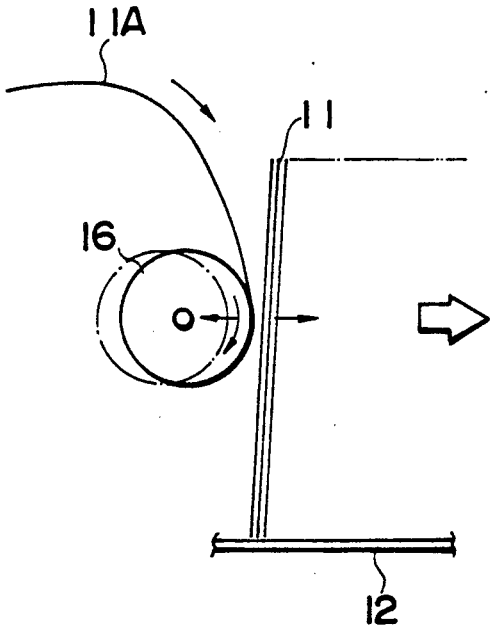
Fig.6a PRIOR ART
FIGS. 6*a* and 6*b* are views for describing the drawbacks of the conventional apparatus.
Figure 6B:
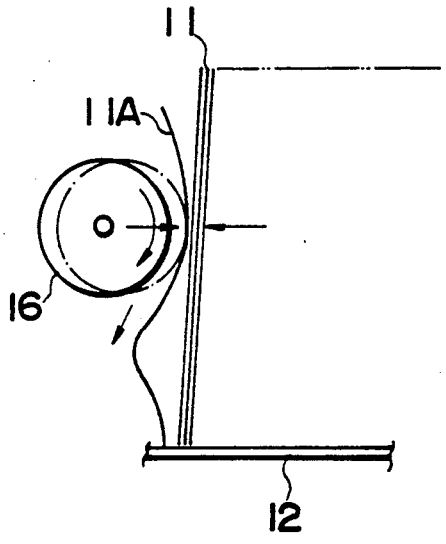
Fig.6b PRIOR ART

In FIG. 1, portions identical with those shown in FIG. 5 are designated by like reference characters and need not be described again. The delivery/stacking apparatus shown in FIG. 1 differs from that of FIG. 5 in that a pressure sensor 28 is attached to the right side (the side which contacts the paper sheets) of the lower end of lever 17 supporting the delivery/stacking roller 16. An example of the pressure sensor 28 is a silicon diaphragm pressure sensor or the like. The pressure sensing surface of the pressure sensor 28 is disposed in the same plane as that in which the delivery/stacking roller 16 contacts the paper sheets 11. Accordingly, the pressure sensor 28 senses the contacting pressure which the delivery/stacking roller 16 applied to the paper sheets 11.

Figure 2:
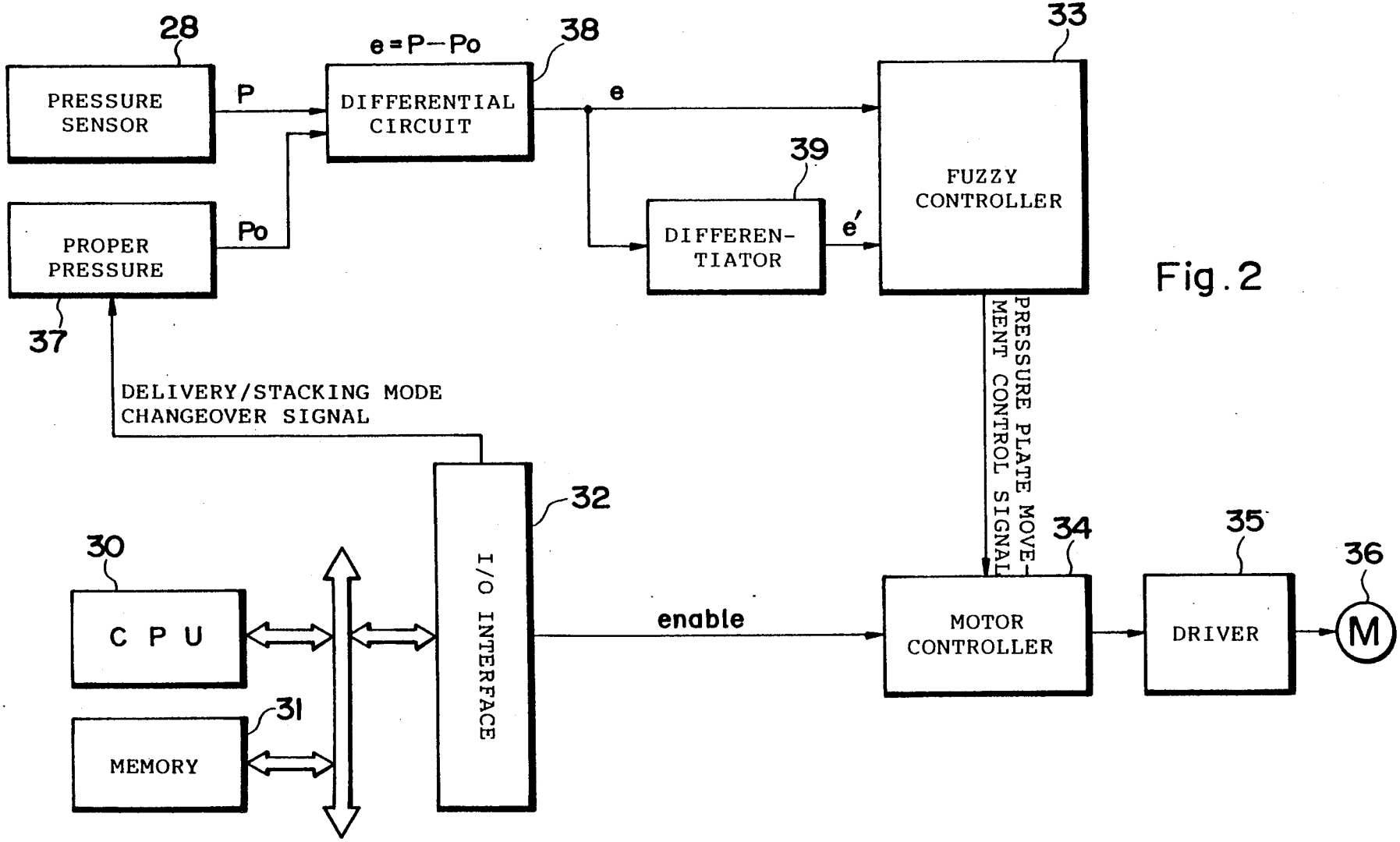
FIG. 2 is a block diagram of a control section of the apparatus.

FIG. 2 is a block diagram illustrating the electrical construction of a control section in the above-described paper sheet delivery/stacking apparatus. A signal indicative of pressure P sensed by the pressure sensor 28 enters a differential circuit 38, where an error e ($=P-P_o$) is obtained between the pressure P and a suitable $P_o$ that has been set in a setting device 37. The suitable pressure $P_o$ differs depending upon whether the prevailing mode is a paper sheet delivery mode or paper sheet stacking mode. A CPU 30 which controls the overall apparatus applies a delivery/stacking mode changeover signal to the setting device 37 via an I/O interface 32. The setting device 37 outputs the suitable pressure $P_o$ for the mode designated by the changeover signal.

The signal indicating the error e outputted by the differential circuit 38 is applied to a fuzzy controller 33 and also to a differentiator 39, where the signal is differentiated. A signal indicating the differentiated value (the amount of change) e' from the differentiator 39 is fed into the fuzzy controller 33.

The fuzzy controller 33 uses the entered error e and the differentiated value e' thereof to perform fuzzy inference in accordance with a control rule, described below, and outputs a signal which controls the movement of the pressure plate 13. This control signal includes command regarding the moving speed of the pressure plate 13 and its direction of movement. A motor controller 34 drives a pressure plate motor 36 via a driver 35 based on the above control signal on the condition that the CPU 30 is outputting a motor drive enable signal via the interface 32. The pressure plate motor 36 is for driving the pressure plate 13 as indicated by the arrows in FIG. 1. Movement of the pressure plate 13 to the left side in FIG. 1 is taken as being positive movement, and movement to the right side is taken as being negative movement.

The fuzzy controller 33, can be constructed of analog or digital type components having a special-purpose fuzzy architecture. It is also possible to realize the fuzzy controller 33 by means of a computer (or microprocessor program). In a case where the fuzzy controller is realized by a computer program, it will be possible for the functions of the differential circuit 38, differentiator 39 and setting device 37 to also be implemented by the computer program.

Examples of inference (control) rules set in the fuzzy controller 33 are as follows:

Rule (1): If there is almost no pressure difference (e=ZR) and pressure (P) is becoming a little smaller (e'=NS),
then the pressure plate is moved a little in the positive direction (V=PS). (If e=ZR and e'=NS, then V=PS).

Rule (2): If pressure (P) is a little high (e=PS) and pressure (P) is becoming a little larger (e'=PS),
then the pressure plate is moved somewhat in the negative direction (V=NM). (If e=PS and e'=PS, then V=NM).

Rule (3) If pressure (P) is a little high (e=PS) and pressure (P) is becoming a little smaller (e'=NS),
then the pressure plate is moved hardly at all (V=ZR). (If e=PS, e'=NS, then V=ZR).

In the foregoing "If . . . " [for example, "If e=ZR and e'=NS" in Rule (1)] is referred to as an antecedent, and "then . . : " [for example, "then V=PS" in Rule (1)] is referred to as a consequent. PL, . . . , ZR, . . . , NL are referred to as labels of membership functions.

In this embodiment, FIG. 3 is obtained when all usable rules are mentioned and put into the form of a table. In the table of FIG. 3, labels of membership functions of the velocity V of the pressure plate are written at the intersections between the error e and its differential e'. The abovementioned rules (1)-(3) are indicated by the codes (1) through (3) in the table of FIG. 3. All of the these rules (there are a total of 49 indicated in FIG. 3) need not be used; fuzzy control is fully possible using only a suitable number of representative rules.

In the table of FIG. 3, the labels have the following meanings:

Regarding the pressure error e:

PL (Positive Large): pressure is fairly high (the pressure error is positive and fairly large);

PM (Positive Medium): pressure is medium high (the pressure error is positive and medium large);

PS (Positive Small): pressure is a little high (the pressure error is positive and small);

ZR (Zero): there is almost no pressure difference;

NS (Negative Small): pressure is a little low (the pressure error is negative and small);

NM (Negative Medium): pressure is medium low (the pressure error is negative and medium small); and NL (Negative Large): pressure is fairly low (the pressure error is negative and fairly large).

Regarding the differentiated value (amount of change) e':

PL: pressure is becoming fairly large;

PM: pressure is becoming medium large;

PS: pressure is becoming a little large;

ZR: there is almost no pressure fluctuation;

NS: pressure is becoming a little small;

NM: pressure is becoming medium small; and

NL: pressure is becoming fairly small.

Regarding velocity V:

PL: pressure plate is moved considerably in the positive direction;

PM: pressure plate is moved medium amount in the positive direction;

PS: pressure plate is moved a little in the positive direction;

ZR: pressure plate is hardly moved;

NS: pressure plate is moved a little in the negative direction;

NM: pressure plate is moved medium amount in the negative direction; and

NL: pressure plate is moved considerably in the negative direction.

Figure 4A:
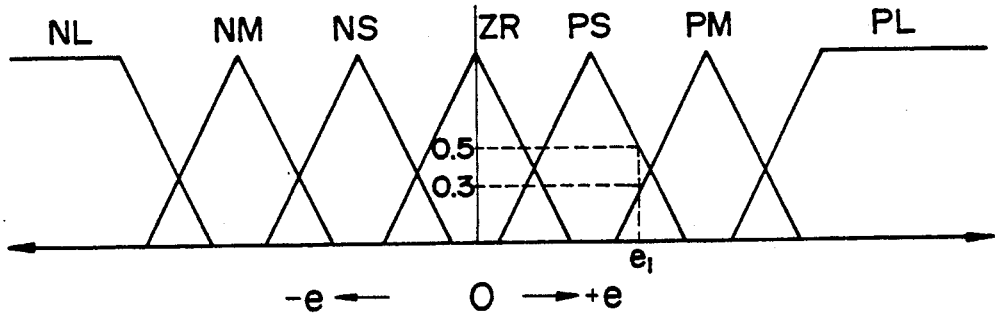
FIGS. 4*a* through 4*c* are views illustrating membership functions.
Figure 4B:
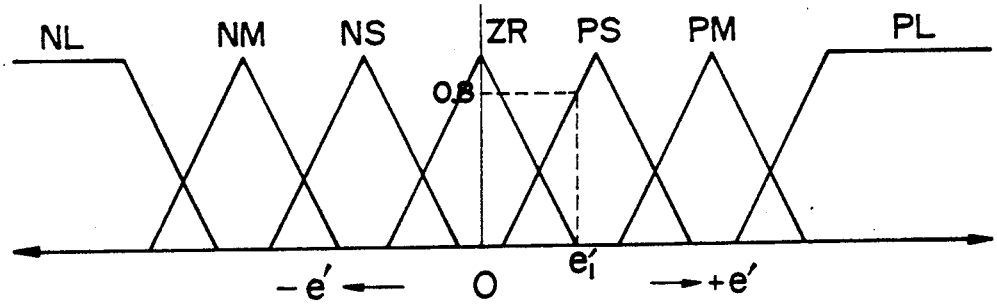
Figure 4C:
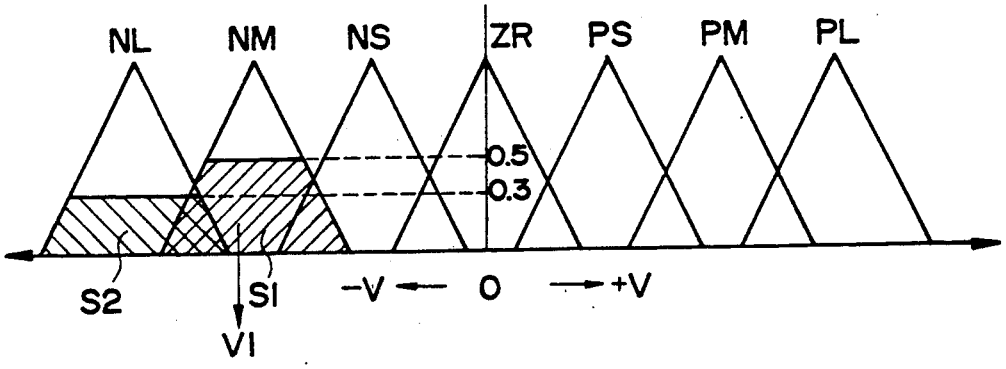

FIGS. 4*a* through 4*c* illustrate an example of membership functions used for the purpose of fuzzy inference in the fuzzy controller 33. FIG. 4*a* illustrates membership functions of the pressure error e, FIG. 4*b* illustrates membership functions of the differentiated value e', and FIG. 4*c* illustrates membership functions of the consequent.

Fuzzy inference in accordance with the MIN-MAX arithmetic rule executed by the fuzzy controller 33 will now be described with reference to FIGS. 4*a* through 4*c*. It goes without saying that fuzzy inference can be executed in accordance with arithmetic rules other than the MIN-MAX arithmetic rule.

For the sake of simplicity, only the following two rules (2), (4) (indicated by the hatching in FIG. 3) will be used:

(2) If e=PS and e'=PS, then V=NM, and (4) If e=PM and e'=PS, then V=NL.

Assume here that the error e ($=P-P_o$) corresponding to the pressure (P) sensed by the pressure sensor is $e_1$ at a certain time. As shown in FIG. 4*a*, the degree to which $e_1$ belongs in the membership function PS (or the suitability of $e_1$) is 0.5, while the degree to which $e_1$ belongs in the membership function PM is 0.3. With regard to the differentiated value e', assume that the amount of change e' in e is $e_1'$. Then, as shown in FIG. 4*b*, the degree to which $e_1'$ belongs in the membership function PS is 0.8.

In Rule (2), of the degree 0.5 to which $e_1$ belongs and the degree 0.8 to which $e_1'$ belongs, the smaller (MIN operation), namely 0.5, is selected, and the membership function NM of the consequent is cut at the degree of belonging 0.5, as shown in FIG. 4*c*. As a result, a trapezoidal membership function $S_1$ is obtained, as indicated by the slanted lines.

Similarly, in Rule (4), of the degree 0.3 to which $e_1$ belongs and the degree 0.8 to which $e_1'$ belongs, the smaller (MIN operation), namely 0.3, is selected,, and the membership function NL of the consequent is cut at the degree of belonging 0.3, as shown in FIG. 4*c*. As a result, a trapezoidal membership function $S_2$ is obtained.

Next, the trapezoidal membership functions $S_1$ and $S_2$ are subjected to a MAX operation (a MAX operation on the operational results of all rules is performed), and the result of the MAX operation (this is also a membership function) is defuzzified. Defuzzification is carried out by taking the center of gravity $V_1$ of the result of the MAX operation, by way of example. The center of gravity $V_1$ is applied to the motor controller 34 as the signal for controlling the movement of the pressure plate 13. As a result, the pressure plate 13 is moved in the negative direction at its center of gravity $V_1$.

By virtue of the foregoing operation, the movement of the pressure plate 13 is controlled. Since the fuzzy controller generally operates at very high speed, pressure control also is performed at very high speed. Accordingly, it is possible to follow up dynamic pressure changes so that the proper pressure can be maintained at all times.

As many apparently widely different embodiments of the present invention can be made without departing from the spirit and scope thereof, it is to be understood that the invention is not limited to the specific embodiments thereof except as defined in the appended claims.

What is claimed is:

1. A paper sheet delivery/stacking apparatus comprising:

a freely movable pressure plate and a delivery/stacking roller for holding a plurality of paper sheets in a substantially upright attitude, and delivery/stacking roller being rotatively driven and disposed opposite said pressure plate with the paper sheets embraced therebetween;

pressure sensing means for sensing pressure, said pressure sensing means being disposed in the vicinity of a position where said delivery/stacking roller contacts said paper sheets to sense a contacting pressure which said delivery/stacking roller applies to said paper sheets;

setting means for setting a predetermined pressure;

differential means for calculating a pressure difference between pressure sensed by said pressure sensing means and a predetermined pressure set by said setting means, and for outputting the calculated pressure difference;

differentiating means for obtaining an amount of change in the pressure difference calculated by said differential means and outputting said amount of change;

movement drive means for moving said pressure plate in a direction in which the paper sheets are arrayed; and fuzzy inference means for receiving the pressure difference calculated by said differential means and the amount of change calculated by said differentiating means as inputs for performing fuzzy inferences in accordance with predetermined control rules set so as to substantially maintain said sensed pressure at said predetermined pressure at all times, said rules include membership functions concerning said pressure difference and said amount of change as antecedents thereof and membership functions concerning the movement of said pressure plate as consequents thereof, and for outputting a signal which controls said movement drive means based on results of said fuzzy inference.

2. The apparatus according to claim 1, wherein said pressure sensing means is provided on a lever supporting said delivery/stacking roller.

3. The apparatus according to claim 1, wherein said setting means selectively outputs a pressure for a delivery operation and a pressure for a stacking operation.

4. The apparatus according to claim 1, further comprising a stacking roller connected to said delivery/-stacking roller by means of a lever wherein said pressure sensing means being disposed on an end of said lever and in the same plane in which said delivery/-stacking roller contacts said paper sheets.

5. The apparatus according to claim 1, wherein said delivery/stacking roller is rotatably driven by a motor such that it is adapted to stack said sheets in a substantially upright attitude.

* * * * *